US009759400B2

(12) United States Patent
Rice et al.

(10) Patent No.: US 9,759,400 B2
(45) Date of Patent: Sep. 12, 2017

(54) VEHICLE LOW-BEAM HEADLAMP WITH CONCAVE REFLECTOR AND SUB-REFLECTOR HAVING TWO CONCAVE REFLECTING SURFACES

(71) Applicants: Lawrence M. Rice, Hillsboro, NH (US); Thomas Tessnow, Weare, NH (US)

(72) Inventors: Lawrence M. Rice, Hillsboro, NH (US); Thomas Tessnow, Weare, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/844,335

(22) Filed: Sep. 3, 2015

(65) Prior Publication Data

US 2017/0067612 A1 Mar. 9, 2017

(51) Int. Cl.
*F21S 8/10* (2006.01)

(52) U.S. Cl.
CPC ..... *F21S 48/1388* (2013.01); *F21S 48/1168* (2013.01); *F21S 48/1186* (2013.01); *F21S 48/1258* (2013.01); *F21S 48/1323* (2013.01); *F21S 48/14* (2013.01)

(58) Field of Classification Search
CPC .. F21S 48/1186; F21S 48/119; F21S 48/1168; F21S 48/1388; F21S 48/1159; F21S 48/14; F21S 48/145; F21S 48/1382
See application file for complete search history.

(56) References Cited

U.S. PATENT DOCUMENTS

| | | | | |
|---|---|---|---|---|
| 1,913,517 | A * | 6/1933 | Smith | F21S 48/1382 362/217.06 |
| 7,121,704 | B2 * | 10/2006 | Takada | F21S 48/1388 362/298 |
| 7,748,880 | B2 * | 7/2010 | Kinoshita | F21S 48/1388 362/299 |
| 8,894,257 | B2 | 11/2014 | Rice et al. | |
| 2009/0052200 | A1 | 2/2009 | Tessnow et al. | |

* cited by examiner

*Primary Examiner* — Robert May
(74) *Attorney, Agent, or Firm* — Edward S. Podszus

(57) ABSTRACT

A vehicle light (1, 11) produces low-beam output using generally spherical distribution light source (7) with increased efficiency. The vehicle light (1) includes transmissive lens (2) through which light exits vehicle light (1); concave reflector (3); light occluding member (100) defining first sub-reflector (6); cut-off edge (4); and second sub-reflector (5). Concave reflector (3) extends upward above light occluding member (100) and directs low-beam light toward transmissive lens (2). Light occluding member (100) is disposed horizontally proximate a longitudinal axis of the vehicle light and low-beam light is reflected between concave reflector (3) and light occluding member (100) toward transmissive lens (2). A second sub-reflector (5) disposed below generally spherical distribution light source (7) has a concave reflecting surface (18, 18*a*, 18*b*), preferably shaped as a wedge of a sphere, to reflect low-beam light, emitted downwardly from generally spherical distribution light source (7), towards concave reflector (3).

18 Claims, 6 Drawing Sheets

VEHICLE LOW-BEAM HEADLAMP WITH CONCAVE REFLECTOR AND SUB-REFLECTOR HAVING TWO CONCAVE REFLECTING SURFACES

TECHNICAL FIELD

The present disclosure relates to a vehicle lamp having a light source emitting light in a generally spherical light distribution and where the vehicle lamp has increased light output.

BACKGROUND

Filament (e.g., incandescent) and high-intensity discharge (HID) light sources are commonly used on many vehicles, such as head lights and fog lights. As may be appreciated, filament light and HID light sources emit light in an approximately spherical light distribution. Many filament and HID lights use a moveable baffle to produce the required light/dark cutoff of a low-beam light pattern, and are usually angled downward and slightly away from oncoming traffic, in order to reduce glare for oncoming vehicles on the opposite side of the road. One example of a moveable baffle is described in U.S. Pat. Pub. 2009/0052200 (Tessnow). Unfortunately, some light emitted from the filament or HID light source strikes the baffle and is wasted, thereby reducing the overall efficiency and output of the filament or HID light design.

While other vehicle light designs exist that produce a low-beam pattern without the use of a moveable baffle, such as for example, U.S. Pat. No. 8,894,257 (Rice and Tessnow), these known vehicle light designs are used with a solid state light source such as a light-emitting diode (LED) light source that emits light within a hemispherical extent; this arrangement would be unsuitable to receive light from a filament lamp that emits light in a generally spherical distribution.

Accordingly, it would be advantageous to have a filament and/or HID light source configuration of vehicle light that produces a low-beam light pattern using a light source that emits light in an approximately spherical light distribution, but lacks moving parts and increases the overall efficiency and output.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF PREFERRED EMBODIMENTS INCLUDING BEST MODE

Figure 1:
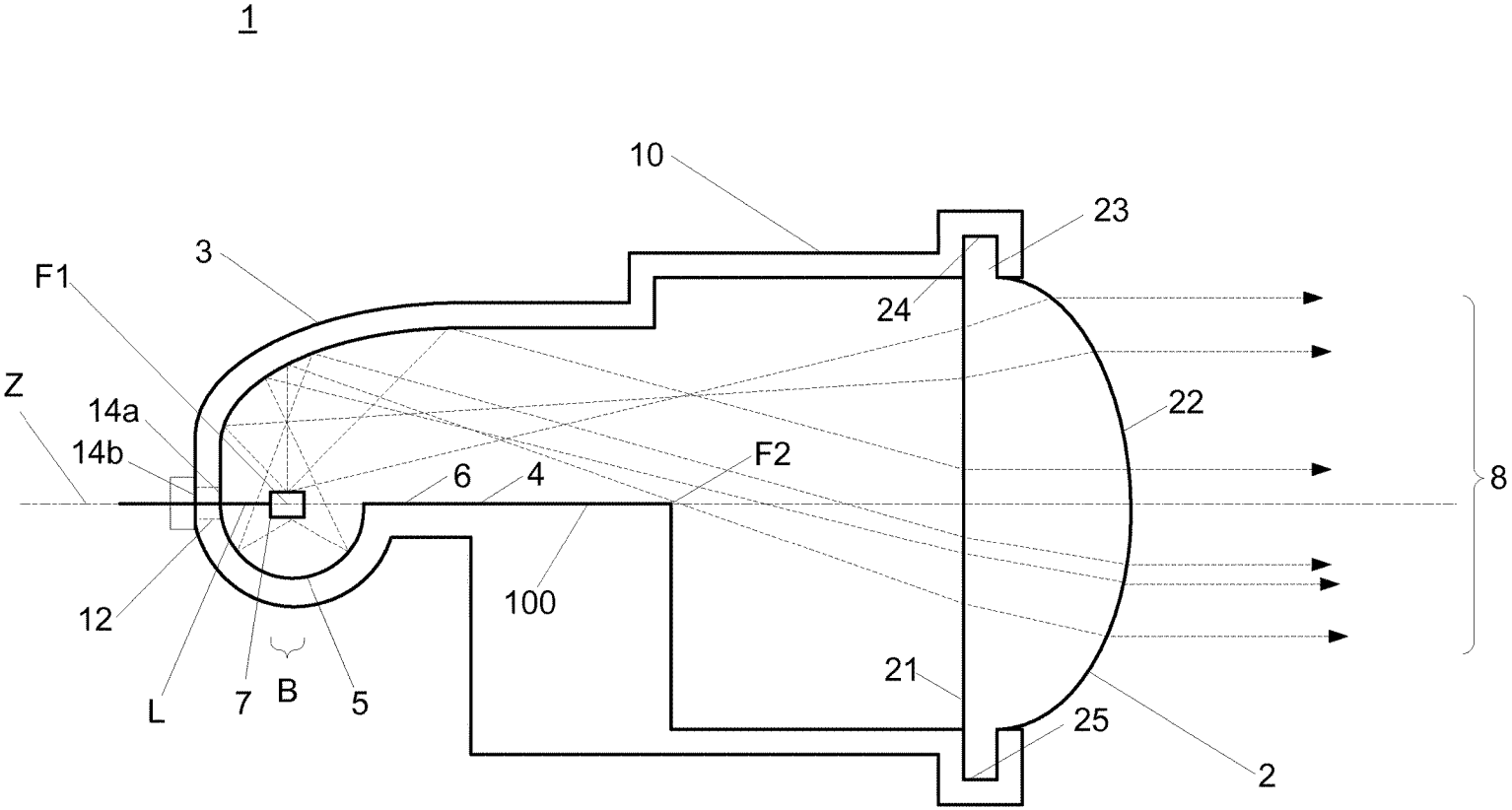
FIG. 1 is a cross-sectional drawing of a configuration of a vehicle light consistent with one embodiment of the present disclosure.

A light source to form a low beam for a vehicle headlamp is often an incandescent (filament) lamp or a high-intensity discharge (HID) lamp; the light distribution from such an energized source is emitted in an approximately spherical light distribution, and so can be referred to as a "generally spherical distribution light source." Light sources that emit light in an approximately spherical light distribution are sometimes also known as "4π light sources," e.g., in contrast to light sources that emit within a hemispherical extent (also known as "2π light source"). Examples of a "generally spherical distribution light source" include, but are not limited to, filament light sources (e.g., standard incandescent lamps having a filament or coil, tungsten halogen lamps, and halogen lamps), HID lamps and fluorescent lights. Sometimes another example of "generally spherical distribution" light source is a plurality of solid state light sources, such as LED arrays, that are aimed in multiple directions (e.g. "omnidirectional") so that, as an array, they are configured to emit light radially in an approximately spherical light distribution. It should be appreciated that the light emitted from a generally spherical distribution light source may not form a perfect spherical distribution pattern. For example, light may not be emitted in a region corresponding to the base of the generally spherical distribution light source, one or more regions corresponding to the electrical leads of the generally spherical distribution light source, and/or spaces/gaps corresponding to regions between adjacent LEDs within an array. As such, the term "approximately spherical light distribution", "generally spherical distribution" or the like is intended to account for these small deviations from the true spherical extent.

As used herein, the term "2π light source" refers to any light source that emits light in half the region as a generally spherical light distribution and an example of such is an LED, or LED array, that emits light in a Lambertian pattern (a pattern which is known in the art to follow the cosine function, with a maximum at 90 degrees perpendicular to an emission plane of the LED and falling off to minima in directions at 0 degrees and 180 degrees generally parallel to an emission plane). An exemplary 2π light source is shown in U.S. Pat. No. 8,894,257 (Rice).

As used herein, the term "low-beam pattern" refers to a vehicle low-beam headlamp pattern or a fog lamp beam pattern, in either of which beam it is desired to have a horizontal cut-off in the beam pattern to avoid glare to oncoming drivers. In contrast, a vehicle lamp "high beam" pattern lacks a defined bright/dark cut-off.

In this document, the directional terms "up", "down", "top", "bottom", "side", "lateral", "longitudinal" and the like are used to describe the absolute and relative orientations of particular elements. For these descriptions, it is assumed that light exits through a "front" of the vehicle light, with a spatial distribution centered on a longitudinal axis that is generally perpendicular to the front of the vehicle light, and is generally parallel to the ground. These descriptions include the minor angular deviations from orthogonality that account for reducing glare for oncoming vehicles. It will be understood that while such descriptions provide orientations that occur in typical use, other orientations are certainly possible. The noted descriptive terms, as used herein, still apply if the vehicle light is pointed upward, downward, horizontally, or in any other suitable orientation.

By way of a general overview, one embodiment of the present disclosure features a vehicle light that produces a low-beam output using a light source that emits light in an approximately spherical light distribution; the vehicle light is devoid of any moving parts, and exhibits increased efficiency and light output. The vehicle light includes a transmissive lens through which light exits the vehicle light, a concave reflector, a light occluding member defining a first sub-reflector, a cut-off edge, and a second sub-reflector. The concave reflector extends upward above the light occluding member and directs low-beam light toward the transmissive lens. The light occluding member is disposed generally horizontally and proximate a longitudinal axis of the vehicle light and low-beam light is reflected between the concave reflector and the light occluding member toward the transmissive lens. The second sub-reflector is disposed below the generally spherical distribution light source and comprises at least one concave reflecting surface, preferably formed as a wedge-shaped portion of a sphere, to reflect light from the generally spherical light distribution, emitted downwardly from the generally spherical distribution light source, generally towards the concave reflector, so as to assist in forming the low-beam pattern. As such, light emitted in a generally spherical light distribution from the light source (e.g., both downwardly and upwardly from the light source), such as from a conventional incandescent or HID light source (i.e., examples of a "4π light source"), may be efficiently reflected towards the transmissive lens in a low-beam pattern, generally as if the light had originated from a "2π light source"-type LED, thereby increasing the efficiency and output of the vehicle light while utilizing a vehicle lamp designed for an LED source.

Again, the above paragraph is merely a generalization of several of the elements and features described in detail below, and should not be construed as limiting in any way.

Figure 2:
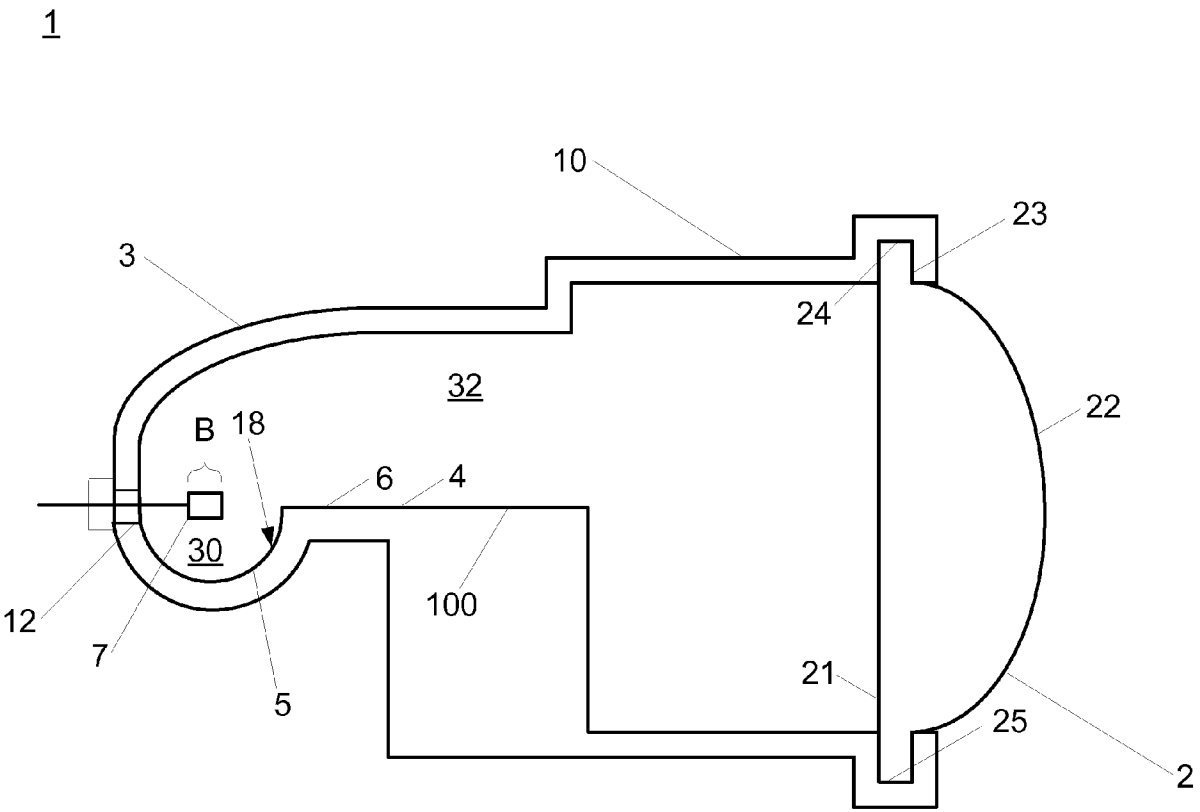
FIG. 2 is a cross-sectional drawing of a configuration of the vehicle light of FIG. 1 without any light rays.
Figure 3:
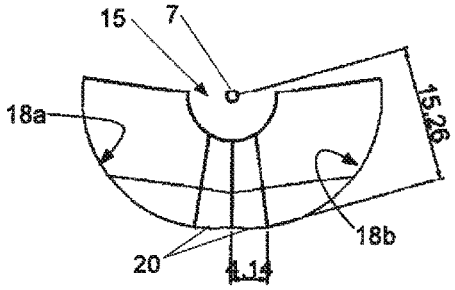
FIGS. 3-6 are various views of one embodiment of a second sub-reflector consistent with the present disclosure.
Figure 4:
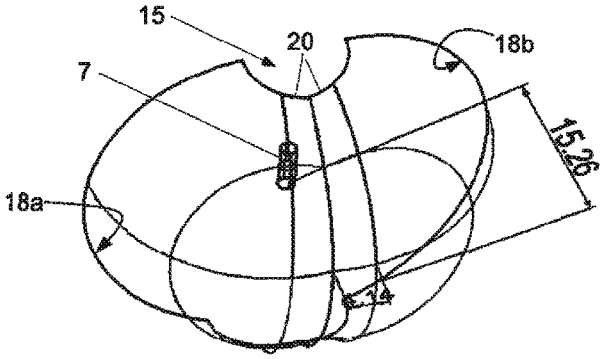
Figure 5:
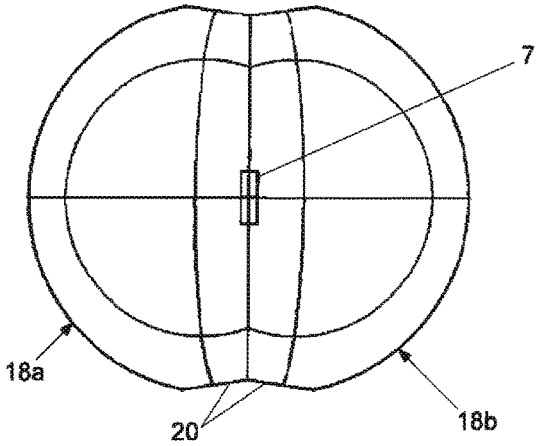
Figure 6:
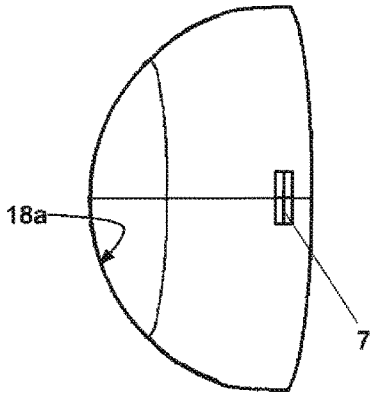

Turning now to FIGS. 1 and 2, FIG. 1 generally illustrates a cross-sectional view of a vehicle light 1 that can produce a low-beam light pattern/output 8 using a generally spherical distribution light source 7 having increased efficiency and light output with no moving parts, and FIG. 2 generally illustrates the vehicle light 1 without any light rays. The vehicle light 1 includes a housing 10 that mechanically supports the internal components.

As a first-order approximation, one may think of the vehicle light 1 having an ellipsoidal reflector 3 with a generally spherical distribution light source 7 at one focus of the ellipsoid 3, a second sub-reflector 5 below the generally spherical distribution light source 7 to reflect light, emitted downwardly from the generally spherical distribution light source 7, generally towards the ellipsoidal reflector 3, an image of the generally spherical distribution light source 7 formed at the second focus of the ellipsoidal reflector 3, and a lens 2 having its focal point coincident with the second focus of the ellipsoidal reflector 3. The light baffle 4 is located close to the second focus. Because the light baffle 4 is at or near the focal point of the lens 2, the bright/dark edge formed by the light baffle 4 becomes a bright/dark edge in the angular output of the low beams. Note that this is merely a first-order approximation. For instance, in order to improve the performance of the angular output, the reflector 3 may deviate from being truly ellipsoidal and may even be non-rotationally symmetric. As another example, the surface profile of the reflector 3 may be adjusted to improve the off-axis performance in imaging the generally spherical distribution light source 7 from the first focus to the second focus. Keeping these first-order approximations in mind, we describe the components of the vehicle light 1 in more detail.

The vehicle light 1 includes a positive lens 2 that transmits the low-beam light pattern/output 8. In the configuration of FIGS. 1 and 2, the side 21 facing the rear of the vehicle light 1 is planar. A potential advantage for using a plano-convex lens is that because the lens surfaces are typically not coated with anti-reflection coatings, a planar incident surface may reduce or minimize the reflection losses at the surface. A curved incident surface may lead to higher Fresnel reflection losses at higher angles of incidence, found at the edges of the beam. Still, if reflection losses do not pose any difficulty, then the inner side of the lens 2 may be curved, either in a convex or concave manner, so that the lens 2 may be bi-convex, meniscus, or plano-convex.

The lens 2 has a convex side 22 facing outward (i.e., toward the front of the vehicle or the like). In most configurations, the convex side 22 is aspheric (i.e., is not purely spherical). Typically, the convex side 22 of the lens includes one or more aspheric terms in its surface prescription, and may optionally include a non-zero conic constant. Optionally, one or both sides of the lens 2 may be rotationally asymmetric, in order improve the output characteristics of the low-beam light pattern/output.

The lens 2 may be "fluted", where one or both sides of the lens may include one or more narrow ribs along its surface. These "flutes" may partially diffuse the light transmitted through the lens, which in some cases may improve the desired performance of the lens 2. The lens flutes, along with the surface profiles and the other geometry inside the housing 10, are one of several elements that can be varied during the design process to produce the desired output.

The lens 2 may have features that can assist with alignment or mounting. For instance, the outer circumference of the lens 2 may have a flange 23 that extends into a suitably sized groove 24 or notch 25 in the housing 10. One or both sides of the flange 23 may be flat, so that the lens may be aligned against a reference surface on the housing 10 by contacting the flat portion of the flange 23.

The lens 2 may be formed from any suitable glass or plastic material. In general, the lens material should be strong enough to endure years of use without fracturing or discoloring. In general, the lens 2 may use any one of a variety of known materials, including any that are used in current generations of vehicle lights. Because the vehicle lights 1 are produced in relatively large quantities, the lenses 2 are typically produced in a known manner by molding.

The lens 2 has a focal point roughly coincident with the second focus F2 of the concave reflector 3.

If the concave reflector 3 were a true ellipsoid, then at it second focus F2 it would form a perfect image of an object placed at its first focus F1. In practice, the imaging is not perfect due to diffraction and due to wavefront aberrations that occur from imaging an extended source (i.e., a generally spherical distribution light source has a finite size) with a nearly ellipsoidal surface. In order to improve the angular characteristics of the low-beam output, the reflector 3 is deviated slightly from a true ellipsoid. This deviation is smallest at the heel of the reflector 3 (i.e., the portion of the reflection that intersects the longitudinal axis Z), and becomes larger farther away from the heel. For the purposes of this document, the reflector 3 is said to be "generally ellipsoidal", where the term "generally" is intended to account for these small deviations from the true ellipsoid. The imaging properties of the two foci still apply for the generally ellipsoidal shape. In other words, low-beam light that originates at the first focus F1 is still imaged onto the second focus F2, and is directed by the concave reflector 3 toward the lens 2.

Note that the concave reflector 3 need not extend fully around the longitudinal axis Z, but may only include the "top" half of the ellipsoid, where the "top" half is farther from the ground than a corresponding "bottom" half would be.

The concave reflector 3 images the light emitted from the generally spherical distribution light source 7 generally from the first focus F1 onto the second focus F2. A light baffle 4 is superimposed onto the image of the generally spherical distribution light source 7 at the second focus F2, which forms a bright/dark edge in the output light pattern. This bright/dark edge falls at the focal point of the lens 2, and becomes a bright/dark edge in angular space for the low-beam output. In other words, the angular output of the low-beam may have a sharp cutoff, with plenty of illumination below a particular threshold angle, and little or no illumination above the threshold angle. Such a sharp bright/dark edge is helpful in reducing glare for drivers in the oncoming direction.

The light baffle 4 may be formed in a variety of manners. In the configuration of FIG. 1, the light baffle 4 is made integral with portions of a light occluding member 100, each of which are described further below. In other configurations, the light occluding member 100 may be made separately from the light baffle 4 and is attached to the light baffle 4. Regardless of how the light baffle 4 and the light occluding member 100 are attached to each other (integral vs. separate), the functions of these two elements remain unchanged. We discuss the functions of each of these elements in more detail, beginning with the light baffle 4.

At its most basic, the light baffle 4 is simply an edge that forms a distinct bright/dark shadow in a low-beam light distribution that strikes the edge. The light baffle 4 may include two generally planar surfaces that intersect in an angled edge, as is shown for the example in FIG. 1. Alternatively, the light baffle 4 may be a dedicated element that can be used to cast a shadow.

As drawn in FIG. 1, the light baffle 4 passes light above the edge and blocks light below the edge. After transmission through the lens 2, the low-beam light pattern 8 shows the edge as being with respect to an angle; light propagating downward (toward the ground) beyond the angular bright/dark edge is passed, while light propagating upward (toward the eyes of oncoming drivers) beyond the angular bright/dark edge is blocked.

In practice, the light baffle 4 is very close to the second focal point F2 of the concave reflector 3, but is displaced slightly from it. The displacement is toward the first focus F1 and away from the lens 2. Such a displacement helps ensure that the angular bright-dark edge does not exhibit significant color artifacts, such as appearing particularly blue or red before going dark. Such artifacts are caused by the property of dispersion in the lens, where the refractive index of the lens differs between the red and blue portions of the spectrum. The displacement discussed here is less than 1 mm, and typically is much less than 1 mm.

The light baffle 4 is shown as being generally horizontal, which is into the page in FIG. 1, and is perpendicular to the longitudinal axis Z. Note that when the vehicle light 1 is in an installed position, a generally horizontal orientation is generally parallel to the ground traversed by the vehicle. Such a horizontal orientation is good for blocking the light for oncoming traffic. In contrast, for illumination toward the shoulder, it is not necessary to enforce the same angular criteria, since there are no oncoming drivers on the shoulder and it may be necessary to read signs that are placed much higher than eye level. Such shoulder illumination may be accomplished easily by angling a portion of the light baffle 4. For instance, one half of the light baffle 4 may be as drawn, such as the half extending out of the page in FIG. 1, while the other half may be inclined azimuthally, such as the half extending into the page in FIG. 1. In other words, looking end-on from the front of the vehicle light 1, the left half of the baffle edge may extend horizontally, much like a clock hand extending to 9 o'clock, while the right half of the baffle edge may deviate from horizontal, much like a clock hand extending to 4 o'clock rather than 3 o'clock. In practice, the inclination may take on values up to 15 degrees or more, in order to achieve sufficient illumination of the shoulder. Note that the specific legal requirements for illumination vary from country to country, and each set of requirements will have its own suitable baffle edge shape. Note that in some cases, the light baffle 4 may have one or more notches or ridges at suitable locations.

Note that in some cases, the light baffle 4 may not lie fully in a single plane, but may bend or curl at its edges. Specifically, for the lateral edges of the baffle closest to the reader (out of the page) and farthest away from the reader (into the page) in FIG. 1, the baffle may bend toward the lens 2. Such a bending may improve the performance of the low-beam output. Note that such a bending may also be a consequence of deviating from a true ellipsoid for the concave reflector 3.

The vehicle light 1 may optionally include a light occluding member 100. The light occluding member 100 (or member 16, discussed herein below), is positioned to prevent light from the generally spherical distribution light source 7 from going below the lower edge of the light baffle 4.

As an example, the configuration of FIG. 1 shows the light occluding member 100 being generally horizontal, and lying approximately in a plane that contains the generally spherical distribution light source 7 and intersects both foci F1, F2 of the concave reflector 3. It should be appreciated, however, that the generally spherical distribution light source 7 may be disposed above and/or below this plane. For example, the generally spherical distribution light source 7 may be disposed slightly above and/or below this plane.

In FIG. 1, the light occluding member 100 is generally parallel to the ground in the interior of the concave reflector 3, typically extending from the generally spherical distribution light source 7 toward the light baffle 4.

It will be understood that as long as the light occluding member 100 blocks light from the generally spherical distribution light source 7 from passing below the lower edge of the light baffle 4, the light occluding member 100 may have any suitable orientation and shape. For instance, the light occluding member 100 may have some orientation other than horizontal, and/or may be inclined or bent as needed, provided that it still may block light from the generally spherical distribution light source 7 from passing below the lower edge of the light baffle 4.

In some configurations, the light occluding member 100 may be a reflective surface, and may be configured as a low-beam reflector 6. Any low-beam light that strikes the low-beam reflector 6 may be reflected back upwards toward the concave reflector 3. In addition, the low-beam reflector 6 prevents low-beam light from passing below the light baffle 4.

In general, for any of the particular configurations, it is envisioned that the amount of light striking the light occluding member 100 will be relatively small, compared to the amount of light passing over the light occluding member 100 and either striking the light baffle 4 or passing over the light baffle 4. If the light occluding member 100 is reflective, then the relatively small amount of light may be reclaimed as useful low-beam light.

As discussed herein, the vehicle light 1 is intended to work with a generally spherical distribution light source 7. The generally spherical distribution light source 7 may be secured to a portion of the housing 10. For example, the generally spherical distribution light source 7 is illustrated having a longitudinal axis L that extends generally parallel to the longitudinal axis Z of the vehicle light 1. As used herein, the longitudinal axis L of the generally spherical distribution light source 7 refers to an axis extending through the bulb portion B of the generally spherical distribution light source 7 in a direction substantially normal to the concave reflector 3. For the purposes of this document, the longitudinal axis L of the generally spherical distribution light source 7 is said to be "generally normal" to concave reflector 3, where the term "generally" is intended to account for small deviations from the true normal.

The housing 10 may include an aperture 12 through which a portion of the generally spherical distribution light source 7 extends through such that a portion of the generally spherical distribution light source 7 (for example, but not limited to, the bulb portion B of the generally spherical distribution light source 7) is disposed within the vehicle light 1. The generally spherical distribution light source 7 may be configured to be secured to the housing 10 in any manner known to those skilled in the art. The aperture 12 may be configured to orientate the generally spherical distribution light source 7 such that the longitudinal axis L of the generally spherical distribution light source 7 is generally parallel with the longitudinal axis Z of the housing 10.

For example, the aperture 12 may have first and second openings 14*a*, 14*b* in the housing 10 which extend in planes that are generally perpendicular to the longitudinal axes L, Z of the generally spherical distribution light source 7 and the housing 10, and generally perpendicular to the ground (not shown for clarity). In the illustrated embodiment, the aperture 12 may be configured to align the longitudinal axis L of the generally spherical distribution light source 7 substantially in the same plane defined by the light occluding member 100, the low-beam reflector 6, and/or the light baffle 4. The aperture 12 may be formed in reflector 3 and/or the second sub-reflector 5. Alternatively (or in addition), the aperture 12 may be formed in an intermediate portion of the housing 10 disposed between the reflector 3 and the second sub-reflector 5.

The aperture 12 may be configured to align the bulb portion B of the generally spherical distribution light source 7 such that at least a portion of the second sub-reflector 5 is disposed below the bulb portion B of the generally spherical distribution light source 7 and at least a portion of the reflector 3 is disposed above the bulb portion B of the generally spherical distribution light source 7. For example, the aperture 12 may be configured to align the bulb portion B of the generally spherical distribution light source 7 such that at least a portion of the second sub-reflector 5 is disposed below the longitudinal axis L of the generally spherical distribution light source 7 and at least a portion of the reflector 3 is disposed above the longitudinal axis L of the generally spherical distribution light source 7. In addition (or alternatively), the aperture 12 may be configured to orientate the bulb portion B of the generally spherical distribution light source 7 such that at least a portion of the light emitted from the generally spherical extent of the generally spherical distribution light source 7 is emitted generally downward towards the second sub-reflector 5 and at least a portion of the light emitted from the generally spherical extent of the generally spherical distribution light source 7 is emitted generally upward towards the reflector 3.

As noted above, the vehicle light 1 also includes a second sub-reflector 5, wherein at least a portion of the second sub-reflector 5 is disposed below the generally spherical distribution light source 7. As used herein, the second sub-reflector 5 is considered to be disposed below the generally spherical distribution light source 7 when at least a portion of the low-beam light emitted downwardly within the generally spherical extent of the generally spherical distribution light source 7 reflects directly against a portion of the second sub-reflector 5. According to one embodiment, the entire second sub-reflector 5 is located below the generally spherical distribution light source 7. According to another embodiment, only a portion of the second sub-reflector 5 is located below the generally spherical distribution light source 7.

The second sub-reflector 5 may be disposed below the plane defined by one or more of the light occluding member 100, the low-beam reflector 6, and/or the light baffle 4. The second sub-reflector 5 may be coupled to a portion of any one or more of the reflector 3, the light occluding member 100, the low-beam reflector 6, and/or the light baffle 4. Alternatively (or in addition), the second sub-reflector 5 may be integral with a portion of any one or more of the reflector 3, the light occluding member 100, the low-beam reflector 6, and/or the light baffle 4.

At least a portion of the second sub-reflector 5 includes at least one generally concave reflecting surface 18 (best seen in FIG. 2) to reflect light, emitted downwardly from the generally spherical distribution light source 7, generally towards the concave reflector 3. As such, the exact configuration of the second sub-reflector 5 (e.g., the generally concave reflecting surface 18) will therefore depend on the size and shape of the bulb portion B of the generally spherical distribution light source 7. One or more portions of the generally concave reflecting surface 18 may have a generally spherical wedge shape, a generally spherical shape, an elongated oval shape, and/or a generally ellipsoid shape in order to improve the reflective characteristics of the second sub-reflector 5 to direct/reflect the low-beam light, emitted downwardly from the generally spherical distribution light source 7, generally towards the concave reflector 3. It should be appreciated that the entire reflective surface of the second sub-reflector 5 may not have a concave shape. For the purposes of this document, the second sub-reflector 5 is said to include a "generally concave reflecting surface," where the term "generally" is intended to refer to the overall surface contour of the second sub-reflector 5 and to account for individual areas of the reflective surface which are not concave. For example, the second sub-reflector 5 may comprise a plurality of planar regions which together have an overall surface configuration which is considered "generally concave."

According to one embodiment, the second sub-reflector 5 includes a single generally concave reflecting surface 18. The single generally concave reflecting surface 18 may be generally hemispherical, though it should be appreciated that the single generally concave reflecting surface 18 may extend greater than, or less than, 180 degrees but less than 360 degrees about a center point. In some cases, the light occluding member 16 and the second sub-reflector 5 define a volume or cavity 32 that opens toward the concave reflector 3. For example, the opening of the volume or cavity 30 (best seen in FIG. 2) may generally coincide with the plane of the light occluding member 16.

The second sub-reflector 5 may also include two or more generally concave reflecting surfaces 18*a*, 18*b* as generally illustrated in FIGS. 3-6. The two or more generally concave reflecting surfaces 18*a*, 18*b* may be symmetrical or asymmetrical with respect to each other. Each of the two or more generally concave reflecting surfaces 18*a*, 18*b* may extend less than 360 degrees about a center point. For example, each of the two or more generally concave reflecting surfaces 18*a*, 18*b* may extend less than, or equal to, 180 degrees about a center point, e.g., less than, or equal to, 90 degrees about a center point. Each of the two or more generally concave reflecting surfaces 18*a*, 18*b* may be configured to redirect the light emitted downwardly from the generally spherical distribution light source 7 such that the return path of the redirected light is close to the bulb portion B of the generally spherical distribution light source 7. Alternatively, or in addition, two or more generally concave reflecting surfaces 18*a*, 18*b* may be configured to redirect the light emitted downwardly from the generally spherical distribution light source 7 such that the return path of the redirected light is close to, but slightly offset from, the bulb portion B of the generally spherical distribution light source 7 to avoid overheating the generally spherical distribution light source 7 with the reflected energy.

The two or more generally concave reflecting surfaces 18*a*, 18*b* may overlap with each other. The two or more generally concave reflecting surfaces 18*a*, 18*b* may be separated by one or more intermediate regions 20. The intermediate regions 20 may have a reflective surface having any surface configuration known to those skilled in the art. For example, one or more of the intermediate regions 20 may have a planar, concave, and/or convex surface. The curvature of the intermediate regions 20 may be the same as and/or different than the curvature of the one or more of the two or more generally concave reflecting surfaces 18*a*, 18*b*. Again, it should be appreciated that the alignment of the two or more generally concave reflecting surfaces 18*a*, 18*b* and/or one or more of the intermediate regions 20 may depend on the size and shape of the bulb portion B of the generally spherical distribution light source 7.

According to one embodiment, the two or more generally concave reflecting surfaces 18*a*, 18*b* may have a partial, generally spherical configuration. As used herein, the term "partial spherical" is intended to mean a concave interior surface corresponding to a partial sphere (i.e., only a portion of a sphere and not a complete sphere, for example, but not limited to, a spherical wedge), wherein the term "generally spherical" is intended to account for small variations from a true sphere. The centers of the two or more partial, generally spherical concave surfaces 18*a*, 18*b* may be offset (e.g., but not limited to, horizontally and/or vertically offset) to the side and/or top of the center of the generally spherical distribution light source 7. Alternatively (or in addition), the centers of the two or more partial, generally spherical concave surfaces 18*a*, 18*b* may be canted inwards towards the center of the generally spherical distribution light source 7. The two or more partial, generally spherical concave surfaces 18*a*, 18*b* may overlap with each other. The two or more generally spherical concave surfaces 18*a*, 18*b* may be separated by one or more intermediate regions 20. The intermediate regions 20 may have any surface configuration.

For example, one or more of generally concave reflecting surfaces 18*a*, 18*b* may have a center point that is horizontally offset to a first and a second side of the generally spherical distribution light source 7. The horizontal offset of the center points of the two or more generally concave reflecting surfaces 18*a*, 18*b* may be based on the dimensions (e.g., but not limited to, a diameter, length, height, and/or width) of the generally spherical distribution light source 7. One or more of the center points of the generally concave reflecting surfaces 18*a*, 18*b* may be canted inwards generally towards a center of the generally spherical distribution light source 7. One or more of the center points of the generally concave reflecting surfaces 18*a*, 18*b* may be generally linearly aligned with a center of the generally spherical distribution light source 7. The center of the generally spherical distribution light source 7 is defined as the center of the bulb portion B of the generally spherical distribution light source 7 (e.g., the center of the filament or the electrodes of the bulb portion B of the generally spherical distribution light source 7). One or more of the generally concave reflecting surfaces 18*a*, 18*b* may have a center point generally aligned with a center of the generally spherical distribution light source 7. One or more of the generally concave reflecting surfaces 18*a*, 18*b* may reflect low-beam light, emitted downwardly from the generally spherical distribution light source 7, generally towards the generally spherical distribution light source 7 and generally towards the concave reflector 3. One or more of the generally concave reflecting surfaces 18*a*, 18*b* may reflect light, emitted downwardly from the generally spherical distribution light source 7, generally proximate to, but not on, the generally spherical distribution light source 7 and generally towards the concave reflector 3.

The second sub-reflector 5 may optionally include a cut-out 15. The cut-out 15 may be provided proximate to the rear of the light 1, may be configured to provide space for the bulb B of the generally spherical distribution light source 7. For example, the cut-out 15 may form a portion of the aperture 12 in the housing 10 through which the bulb B of the generally spherical distribution light source 7 extends into the housing 10.

Figure 7:
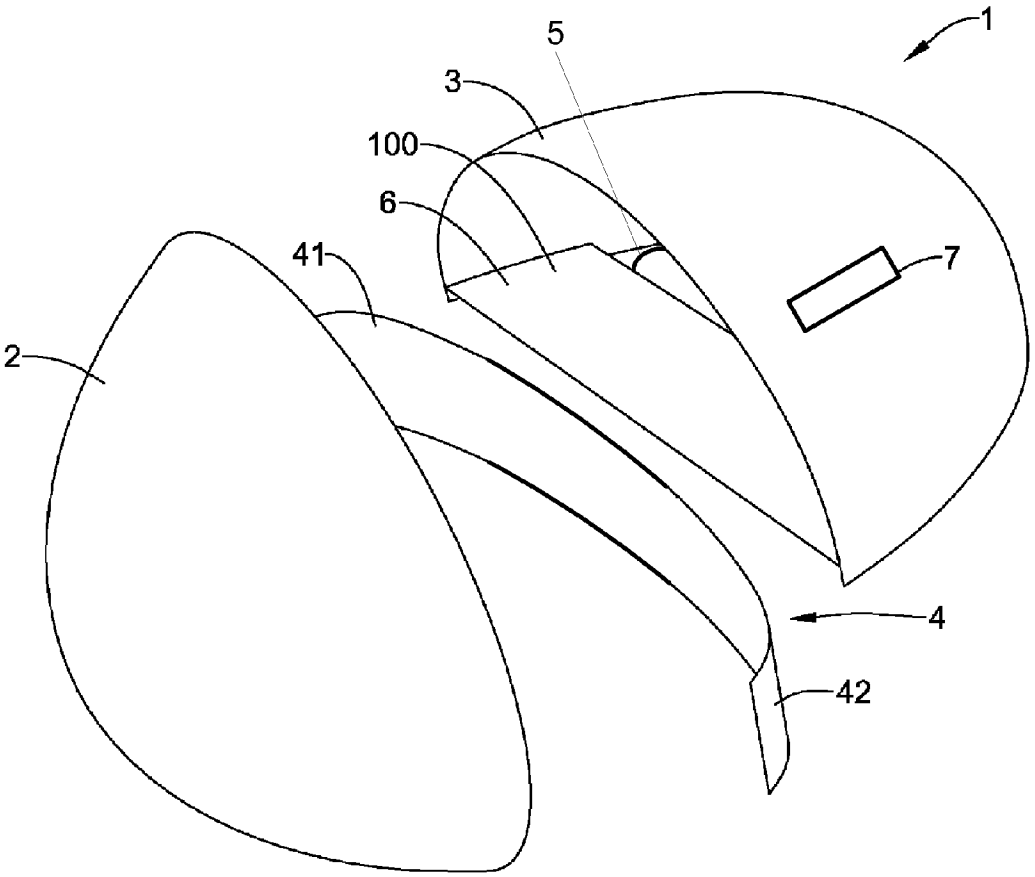
FIG. 7 is a perspective exploded-view of another embodiment of a vehicle light consistent with the present disclosure.

With reference to FIG. 7, one embodiment of a perspective exploded-view drawing of the vehicle light 1 of FIG. 1 is generally illustrated. It is instructive to consider the paths that light would take in FIG. 7, even though no rays are drawn in FIG. 7. In FIG. 7, light originates from the generally spherical distribution light source 7. A portion of the low-beam light is emitted generally upwards from the generally spherical distribution light source 7 onto the concave reflector 3. The concave reflector 3 directs this light generally towards to the aspheric lens 2. A portion of the low-beam light is emitted generally downwards from the generally spherical distribution light source 7 onto the second sub-reflector 5. The second sub-reflector 5 directs this light generally towards to the concave reflector 3, and the concave reflector 3 ultimately directs the light towards the aspheric lens 2 as described herein.

Most of the light reflected from the concave reflector 3 passes over the light baffle 4 to strike the lower half of the lens 2 and be bent downward, toward the ground. A smaller fraction of the light strikes the light occluding member 100; for the configuration in which the light occluding member 100 is reflecting as a low-beam reflector 6, the light is reflected back upwards toward the lens 2 and/or the concave reflector 3 (which ultimately redirects the light towards the aspheric lens 2). The aspheric lens 2 bends the light generally downward, toward the ground.

The light baffle 4 may extend horizontally away from the light occluding member 100 and/or low-beam reflector 6. For example, the lateral, horizontal edges 41, 42 of the light baffle 4 may bend toward the lens 2. In other configurations, the light baffle 4 may be generally planar and may be generally vertical.

A bright/dark edge is formed in the low-beam light, arising from the light baffle 4, or it may arise from an edge of low-beam reflector 6, which can include a reflecting surface generally parallel with the ground. Alternatively, the bright/dark edge may be formed by an edge 63, FIG. 8, of a light occluding member 16. The low-beam light proceeds generally toward the bottom half of the aspheric lens 2, which directs it out of the vehicle light 1 in front of the vehicle.

Figure 8:
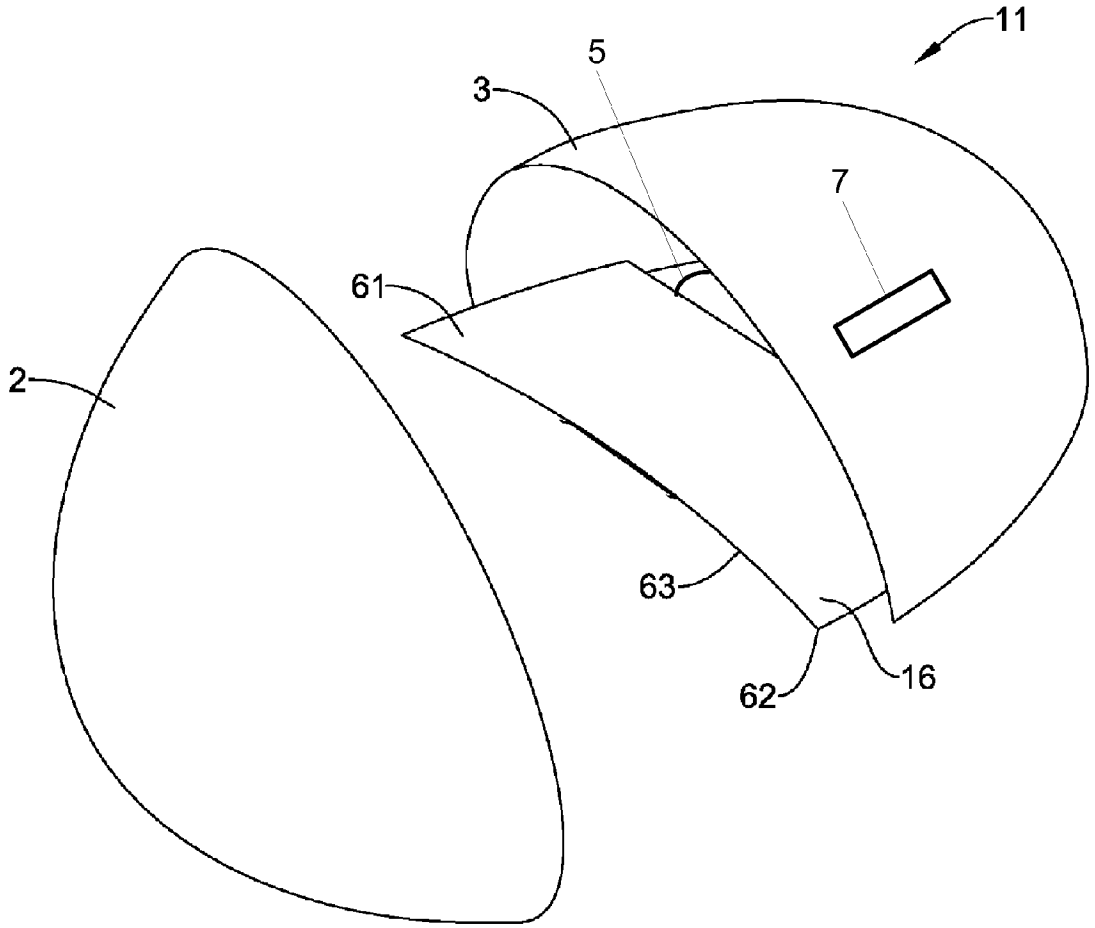
FIG. 8 is a perspective exploded-view of yet another embodiment of a vehicle light consistent with the present disclosure.

With reference to FIG. 8, the light occluding member 16 may extend further toward the lens 2 at its horizontal lateral edges 61, 62 than at its center, which is near the second sub-reflector 5. In some cases, the extension is left/right symmetric is shown in FIG. 8. In other cases, the extension is left/right asymmetric. For example, one horizontal lateral edge 61 (or 62) may extend farther toward the lens 2 than the other horizontal lateral edge 62 (or 61). Alternatively, the shape of the front edge 63 of the light occluding member 16 may be left/right asymmetric, in order to help produce the asymmetric output distribution described above.

In some cases, the light occluding member 16 is planar. In some of those cases, the plane of the light occluding member 16 is horizontal, or parallel to the ground. In others of those cases, the plane of the light occluding member 16 is inclined with respect to the ground. For instance, the plane may be tilted forward, so that the front edge 63 of the light occluding member 16 is closer to the ground than the rear of the light occluding member 16. In some cases, the orientation of the plane may be left/right symmetric. In other cases, the plane may be tilted toward the left or the right of the vehicle light 1. In all of these cases, the light occluding member 16 is said to be "generally parallel" to the ground during use, even if the light occluding member 16 is inclined by one degree, two degrees, three degrees, four degrees, five degrees, ten degrees or more than ten degrees.

In some cases, the light occluding member 16 deviates from a plane. For instance, there may be some overall curvature to the light occluding member 16, or some localized curvature such as curling, ripples or waves at particular locations on the light occluding member 16.

In some cases, the light occluding member 16 extends laterally toward the concave reflector 3. In some cases, the light occluding member 16 and the concave reflector 3 define a volume or cavity 32 (best seen in FIG. 2) that opens toward the lens 2, where the opening of the volume or cavity 32 generally coincides with a top half of the lens 2. In some of these cases, the opening of the volume or cavity 32 may be slightly smaller or slightly larger than the top half of the lens 2. In some cases, the light occluding member 16 is at or near the longitudinal axis of the vehicle light 11.

In some cases, the light occluding member 16 may extend laterally all the way out to the concave reflector 3. Such an extension may be complete around the relevant portion of the perimeter of the light occluding member 16, or may optionally include one or more breaks for clearance, ventilation, or other reasons. In other cases, the light occluding member 16 may extend out to, but not contact, the concave reflector 3.

Note that all or nearly all of the low-beam light shown exiting from the aspheric lens 2 leaves the vehicle light 1 propagating to the right with a slight downward inclination, with none or little light propagating with a slight upward inclination. In general, the emission pattern of the low-beam light exits the vehicle light 1 at lens 2, is deliberately left/right asymmetric, so that some low-beam light may propagate upwards on the shoulder and may illuminate signs higher than eye level, while low-beam light is kept out of the eyes of oncoming drivers on the opposite side of the road. For this reason, in the U.S. (and other regions that drive on the right side of the road), low-beam light leaving the vehicle light 1 and propagating slightly to the right of the driver may have more upward-traveling light than that propagating slightly to the left of the driver. This situation is reversed for regions that drive on the left side of the road.

There are several known ray-tracing programs that are commonly used to simulate the performance of the vehicle light and optimize the vehicle light design. For instance, the program LucidShape is computer aided designing software for lighting design tasks, and is commercially available from the company Brandenburg GmbH, located in Paderborn, Germany. Other known computer software may also be used.

Note that adjustment of the low-beam output profile is done in a routine manner at the simulation stage of the vehicle light design. The output profile may be simulated by a variety of ray-tracing computer software, all of which can adjust the shapes and orientations of the generally spherical distribution light source 7, the concave reflector 3, the light occluding member 100, the light baffle 4 and the lens 2. In general, all of these components except the lens 2 contribute only to the low-beam light output, and may be adjusted as needed without altering the high-beam output of the vehicle light 1.

Through comparison of simulated contour plots of low-beam output of a headlamp using a conventional H1-type halogen-filled filament lamp to that of a vehicle light 1 consistent with the present disclosure, a vehicle light 1 consistent with the present disclosure achieved an increase in far field lumens.

In general, a starting point for a typical design may use a rotationally symmetric ellipsoid as the concave reflector 3. The software may then adjust the surface profile of the concave reflector 3, and other components, to improve the performance, and coax the light output to resemble a desired set of specifications. The final concave reflector 3 may resemble an ellipsoid, but may deviate from a true ellipsoid, especially in the region closest to the lens 2. The final concave reflector 3 may also be rotationally asymmetric, which may improve performance without complicating the manufacturing process, since the components are typically produced by molding, rather than grinding and polishing.

Figure 9:
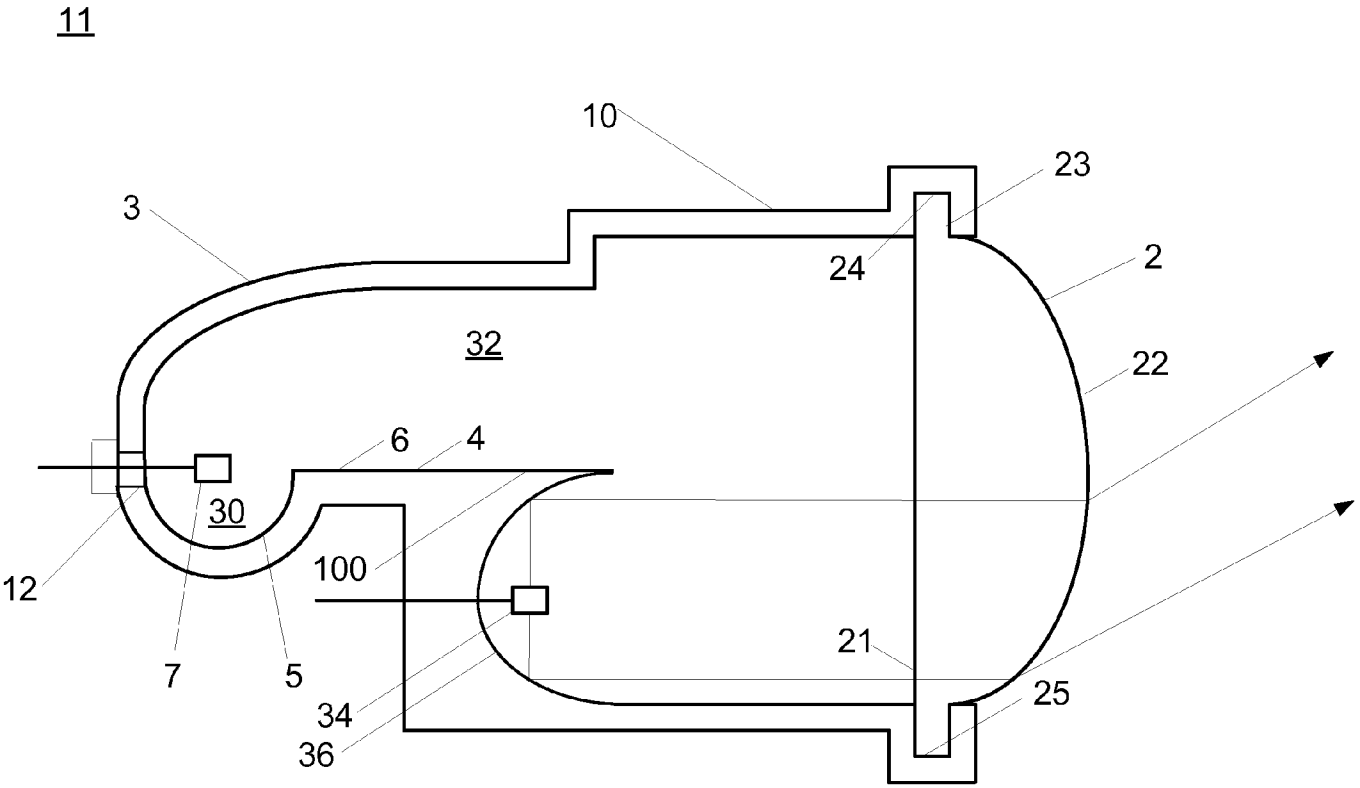
FIG. 9 is a cross-sectional drawing of one embodiment of a vehicle light having both a high beam and low beam consistent with the present disclosure.

Turning now to FIG. 9, one embodiment of a vehicle light 11 including an optional high beam light source 34 and high beam light reflector 36 are generally illustrated. It should be appreciated that the vehicle light 11 may include any embodiment of the low-beam described herein as well as in FIGS. 1-8. The high beam light source 34 may include any known light source such as, but not limited to, incandescent lights, HID lights, and solid state lights (e.g., LEDs). The high beam light reflector 36 is configured to receive high-beam light from the high beam light source 34 and direct the reflected high-beam light towards the lens 2. The high beam light reflector 36 may therefore feature any reflective surface contour known to those skilled in the art. At least a portion of the reflected high-beam light from the high beam light source 34 exits the lens 2 above the horizon. As such, the reflected high-beam light lacks a bright/dark edge.

For the designs shown in FIGS. 1-8, the bright/dark edge in the low beam light is formed by an explicit light baffle 4. In some alternate designs, it may be possible to remove the light baffle 4, to extend the front edge of the light occluding member 100 forward (toward the lens 2), and to use the extended front edge of the light occluding member 100 to form the bright/dark edge in the low beam light. Such a design may be simpler and less expensive to produce than the designs of FIGS. 1-8, since it includes the same functionality with one fewer piece part.

Unless otherwise stated, use of the words "substantial" and "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

GLOSSARY: A NON-LIMITING SUMMARY OF ABOVE REFERENCE NUMERALS

1 vehicle light
2 lens
3 concave reflector
4 light baffle
5 second sub-reflector
6 low-beam reflector
7 generally spherical distribution light source
8 low-beam light pattern
10 housing
11 vehicle light
12 aperture
14*a*, 14*b* openings
15 cut-out
16 light occluding member
18 generally concave reflecting surfaces
20 intermediate region
21 planar side of lens
22 convex side of lens
23 flange of lens
24 groove in housing
25 notch in housing
30 volume or cavity of second sub-reflector
32 volume or cavity of concave reflector
34 high beam light source
36 high beam reflector
41 horizontal lateral edge of light baffle
42 horizontal lateral edge of light baffle
61 horizontal lateral edge of light occluding member
62 horizontal lateral edge of light occluding member
63 front edge of light occluding member
100 light occluding member
B bulb portion of generally spherical distribution light source
F1 first focus of concave reflector
F2 second focus of concave reflector
L longitudinal axis of generally spherical distribution light source
Z longitudinal axis of housing

What is claimed is:

1. A vehicle light (1, 11) producing a low-beam pattern and having a generally horizontal longitudinal axis (Z), comprising:

a transmissive lens (2) through which light exits the vehicle light;

a concave reflector (3) that receives low-beam light from a generally spherical distribution light source (7) and directs reflected low-beam light toward the transmissive lens (2);

a light occluding member (100) disposed generally horizontally and proximate a longitudinal axis (Z) of the vehicle light, wherein the concave reflector (3) extends upward above the light occluding member (100); and wherein low-beam light is reflected between the concave reflector (3) and the light occluding member (100) toward the transmissive lens (2); and wherein the light occluding member (100) defines a first sub-reflector (6);

a cut-off edge (4) disposed adjacent to the transmissive lens (2) that blocks a portion of the reflected low-beam light and forms a bright/dark edge in the reflected low-beam pattern; and a second sub-reflector (5) disposed below the generally spherical distribution light source (7) and comprising first and second generally concave reflecting surfaces (18, 18*a*, 18*b*) to reflect low-beam light, emitted generally downwardly from the generally spherical distribution light source (7), generally towards the concave reflector (3);

wherein the first and second generally concave reflecting surface (18*a*, 18*b*) are disposed on opposite sides of a longitudinal axis (L) of the generally spherical distribution light source (7), respectively.

2. The vehicle light (1, 11) of claim 1, wherein the at least one generally concave reflecting surface (18, 18*a*, 18*b*) has a generally spherical wedge shape.

3. The vehicle light (1, 11) of claim 1, wherein the first and second partial generally concave reflecting surfaces (18*a*, 18*b*) partially intersect.

4. The vehicle light (1, 11) of claim 3, wherein the first and second generally concave reflecting surface (18*a*, 18*b*) each have a center point generally aligned with a center of the generally spherical distribution light source (7).

5. The vehicle light (1, 11) of claim 3, wherein the first and second generally concave reflecting surface (18*a*, 18*b*) each reflect low-beam light, emitted downwardly from the generally spherical distribution light source (7), generally towards the generally spherical distribution light source (7) and generally towards the concave reflector (3).

6. The vehicle light (1, 11) of claim 3, wherein the first and second generally concave reflecting surface (18*a*, 18*b*) each reflect low-beam light, emitted downwardly from the generally spherical distribution light source (7), generally proximate to, but not on, the generally spherical distribution light source (7) and generally towards the concave reflector (3).

7. The vehicle light (1, 11) of claim 1, wherein the first and second generally concave reflecting surface (18*a*, 18*b*)

each have a center point that is horizontally offset to a first and a second side of the generally spherical distribution light source (7).

8. The vehicle light (1, 11) of claim 7, wherein the horizontal offset of the center points is based on a diameter of the generally spherical distribution light source (7).

9. The vehicle light (1, 11) of claim 7, wherein the center points of the first and second generally concave reflecting surface (18*a*, 18*b*) are each canted inwards generally towards a center of the generally spherical distribution light source (7).

10. The vehicle light (1, 11) of claim 7, wherein the center points of the first and second generally concave reflecting surface (18*a*, 18*b*) are each generally linearly aligned with a center of the generally spherical distribution light source (7).

11. The vehicle light (1, 11) of claim 1, wherein the light occluding member (100) and the concave reflector (3) define a volume (32) that opens toward the transmissive lens (2); and wherein the opening of the volume (32) generally coincides with a top half of the transmissive lens (2).

12. The vehicle light (1, 11) of claim 1, wherein the concave reflector (3) comprises a top half of a generally ellipsoid shape; and wherein the light occluding member (100) bisects the generally ellipsoid shape to define a boundary of the top half.

13. The vehicle light (1, 11) of claim 1, wherein the light occluding member (100) extends generally horizontally along the longitudinal axis (Z) from an upper edge of the second sub-reflector (5).

14. The vehicle light (1, 11) of claim 13, wherein the cut-off edge (4) is defined by a front edge (63) of the light occluding member (100).

15. The vehicle light (1, 11) of claim 1, further in combination with the generally spherical distribution light source (7), wherein the generally spherical distribution light source (7) is chosen from the group consisting of a filament lamp and a high intensity discharge lamp.

16. The vehicle light (1, 11) of claim 1, wherein the cut-off edge (4) bends away from the concave reflector (3) and towards the transmissive lens (2) at its horizontal lateral edges (41, 42, 61, 62).

17. The vehicle light (1, 11) of claim 1, further in combination with the generally spherical distribution light source (7), wherein a longitudinal axis (L) of the generally spherical distribution light source (7) extends generally parallel to the longitudinal axis (Z).

18. A vehicle light (1, 11) producing a low-beam pattern and having a generally horizontal longitudinal axis (Z), comprising:

a transmissive lens (2) through which light exits the vehicle light;

a concave reflector (3) that receives low-beam light from a generally spherical distribution light source (7) and directs reflected low-beam light toward the transmissive lens (2);

a light occluding member (100) disposed generally horizontally and proximate a longitudinal axis (Z) of the vehicle light, wherein the concave reflector (3) extends upward above the light occluding member (100); and wherein low-beam light is reflected between the concave reflector (3) and the light occluding member (100) toward the transmissive lens (2); and wherein the light occluding member (100) defines a first sub-reflector (6);

a cut-off edge (4) disposed adjacent to the transmissive lens (2) that blocks a portion of the reflected low-beam light and forms a bright/dark edge in the reflected low-beam pattern; and a second sub-reflector (5) disposed below the generally spherical distribution light source (7) and comprising first and second generally concave reflecting surfaces (18, 18*a*, 18*b*) to reflect low-beam light, emitted generally downwardly from the generally spherical distribution light source (7), generally towards the concave reflector (3);

wherein the cut-off edge is defined by a top edge of a light baffle (4), the light baffle (4) being disposed generally perpendicular to the longitudinal axis (Z) and extending generally laterally horizontally between opposing sides of the concave reflector (3), wherein the top edge is adjacent a focus of the concave reflector (3).

* * * * *